US005332417A

United States Patent [19]

Bauvois

[11] Patent Number: 5,332,417

[45] Date of Patent: Jul. 26, 1994

[54] METHOD FOR DECARBURISATION OF STEEL IN A VACUUM TREATMENT CHAMBER AND VACUUM TREATMENT CHAMBER FOR IMPLEMENTING THE METHOD

[75] Inventor: Bernard Bauvois, Loon Plage, France

[73] Assignee: Sollac, Puteaux, France

[21] Appl. No.: 966,060

[22] PCT Filed: May 7, 1992

[86] PCT No.: PCT/FR92/00416

§ 371 Date: Mar. 11, 1993

§ 102(e) Date: Mar. 11, 1993

[87] PCT Pub. No.: WO92/20986

PCT Pub. Date: Nov. 26, 1992

[30] Foreign Application Priority Data

May 13, 1991 [FR] France ..... 91 05753

[51] Int. Cl.[5] ..... C21C 7/10

[52] U.S. Cl. ..... 75/510; 75/511; 75/512

[58] Field of Search ..... 75/510–512

[56] References Cited

U.S. PATENT DOCUMENTS 4,071,356 1/1978 Yamamoto ..... 75/512
4,104,057 8/1978 Maas et al. ..... 75/49

FOREIGN PATENT DOCUMENTS 0328851 8/1989 European Pat. Off. .
2542014 9/1984 France .

OTHER PUBLICATIONS

Gmelin Handbook, vol. A, No. 9, p. 191A; Gmelin--Durrer: "R.H.O. Process".
Patent Abstracts of Japan, vol. 14, No. 57 (C-684)(4000), Feb. 2, 1990, abstract No. 1-283316.

*Primary Examiner*—Peter D. Rosenberg
*Attorney, Agent, or Firm*—Oblon, Spivak, McClelland, Maier & Neustadt

[57] ABSTRACT

Method for decarburisation of steel in a vacuum treatment chamber consisting of an upper part (4) in the shape of a bell, of an intermediate ring (5) and of a lower part (6) in which the bath of metal to be treated (2) is located and which is equipped with two legs (7, 8) which are immersed in the steel ladle (9) containing all the metal (10) to be treated, characterised in that oxygen is blown horizontally over the bath of metal to be treated (2), at the level of the intermediate ring (5), substantially at the centre of the latter.

Vacuum steel-treatment chamber in which at least two horizontal tuyeres (11, 12) are provided in the intermediate ring (5) of the said chamber, substantially in the centre of the latter.

5 Claims, 1 Drawing Sheet

METHOD FOR DECARBURISATION OF STEEL IN A VACUUM TREATMENT CHAMBER AND VACUUM TREATMENT CHAMBER FOR IMPLEMENTING THE METHOD

The present invention relates to a method for decarburisation of steel in a vacuum treatment chamber and a vacuum treatment chamber for implementing the method.

In order to treat steel from the converter in which it is produced, it is known to use a vacuum treatment chamber, widely known as RHOB (Rheinstahl Heraus Oxygen Blowing).

A chamber of this type is used to perform decarburisation treatments or a dehydrogenation as well as mild treatments consisting in producing a steel in which the ranges of the various additives are reduced to such a point that it is impossible to obtain it directly in the converter.

It is known to use a vacuum treatment chamber consisting of three parts:

- an upper part, known as the top of the shaft, having the shape of a bell,
- an intermediate ring in which the steel to be treated is located,
- a lower part, known as the bottom of the shaft, equipped with two legs which are immersed in the steel ladle containing the steel to be treated.

During the decarburisation treatment of the steel, that is to say the treatment which gives it a carbon content of less than 40 ppm, it is known to inject a certain amount of oxygen over the bath of metal contained in the treatment chamber.

Thus, the carbon contained in the bath of metal to be treated reacts with the oxygen supplied according to the reaction:

$$C+\tfrac{1}{2}\,O_2 \rightarrow CO$$

The oxygen is conveyed to the level of the bath of molten metal to be treated by means of a lance which is immersed in the treatment chamber.

The drawback of this method lies in the fact that oxygen is blown vertically relative to the walls of the treatment chamber, that is to say it never enters into direct contact with the vertical walls of the chamber on which deposits of metal are formed due to the splashes originating from the bath of metal during treatment.

These deposits, known as build-up, accumulate in the treatment chamber, end up by increasingly restricting the free part of the chamber and can prevent the passage of the treatment lance.

Moreover, the deposits on the walls of the chamber contain a certain amount of carbon depending on the carbon content of the steel during previous treatments.

Thus, during decarburisation treatments, the metal to be treated sweeps over these deposits during its circulation in the intermediate ring of the chamber, this circulation being due to the blowing of a neutral gas in one of the legs with which the bottom part of the said chamber is equipped.

A proportion of the deposit is thus remelted, which may give rise to recarburisation of the metal to be treated in the chamber.

It is thus necessary to remove these deposits by means of a treatment, called slag-out, in which oxygen is blown directly onto the build-up in order to form an iron oxide which falls into the base of the shaft.

Such a slag-out treatment is necessary approximately every 15 treatments of steel in the chamber.

A further drawback lies in the leaktightness required at the level of the passage of the treatment lance into the upper part of the chamber. In fact, as the chamber has to be kept under vacuum during the treatment, leaktightness is very difficult to achieve.

The aim of the present invention is to provide a method for decarburisation of steel in a vacuum treatment chamber consisting of an upper part in the shape of a bell, of an intermediate ring in which the bath of metal to be treated is located and of a lower part equipped with two legs which are immersed in a steel ladle containing the steel to be treated, into which oxygen is blown horizontally over the bath of metal to be treated.

The present invention also relates to a vacuum steel-treatment chamber for implementing the above method, in which at least two horizontal tuyeres are provided in the intermediate ring of the said chamber, substantially in the centre of the latter.

BRIEF DESCRIPTION OF THE DRAWING

The figure shows a sectional view of a vacuum treatment chamber according to the invention.

DETAILED DESCRIPTION

Figure 1:
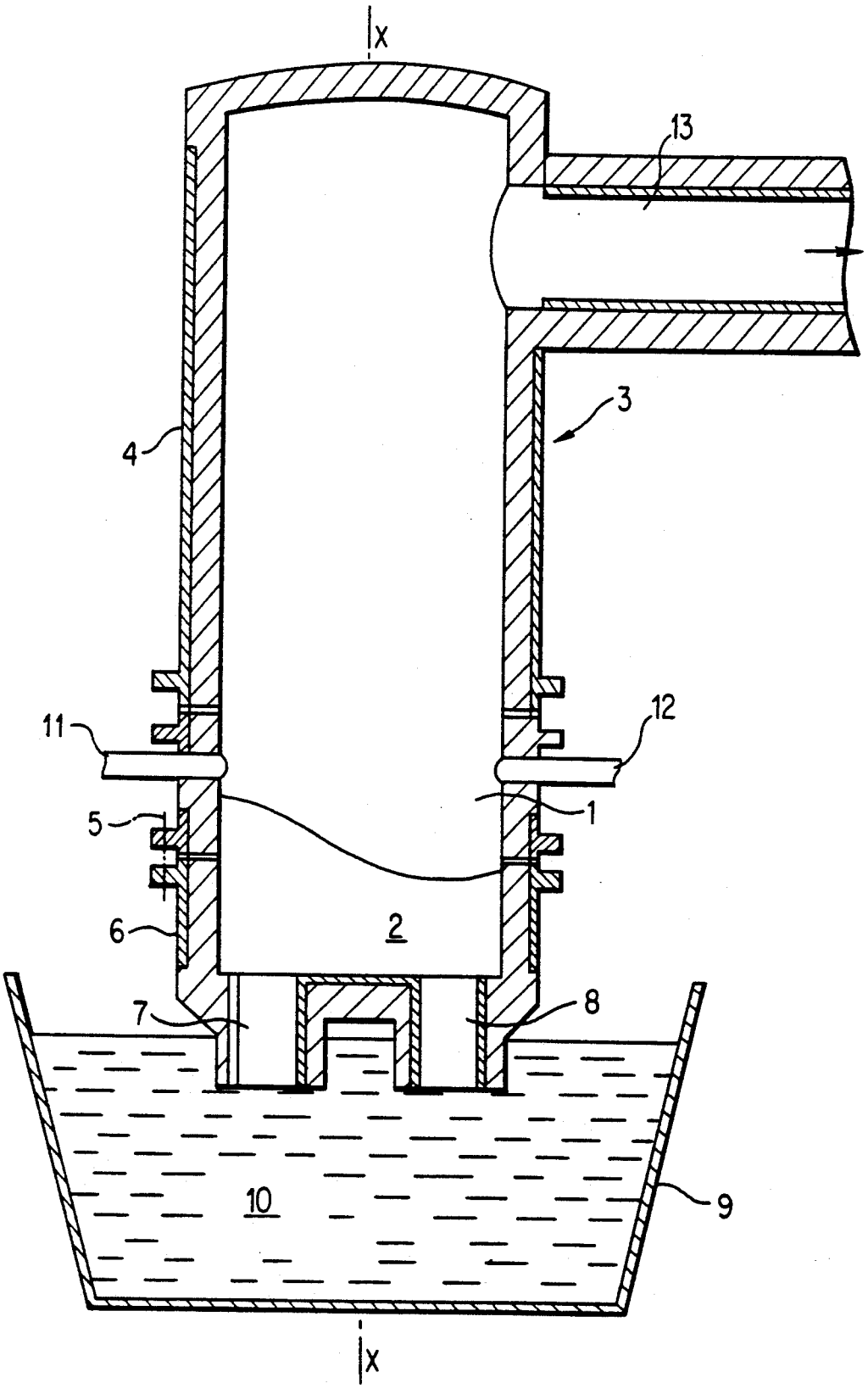

The features and advantages will become apparent during the description which follows, given solely by way of example and given with reference to the appended drawing showing a sectional view of a vacuum treatment chamber according to the invention.

The method for decarburisation of steel according to the invention consists in conveying a stream of oxygen 1 over the bath of metal to be treated 2 which is located in a vacuum treatment chamber 3 consisting of an upper part 4 in the shape of a bell, of an intermediate ring 5 and of a lower part 6 comprising two legs 7, 8 immersed in a steel ladle 9 containing all the steel 10 to be treated.

The vacuum is achieved by means of a vacuum-pump device of known type, not shown, connected on the duct 13 with which the upper part 4 of the chamber is equipped.

The important feature lies in the fact that the oxygen is conveyed horizontally into the treatment chamber, that is to say perpendicularly to the axis X—X of the said chamber.

Thus, the oxygen sweeps over the bath 2 of metal to be treated contained in the intermediate ring. This oxygen reacts with the carbon contained in the metal according to the reaction:

$$C+\tfrac{1}{2}\,O_2 \rightarrow CO$$

and with the CO released during the decarburisation reaction, according to the reaction $CO+\tfrac{1}{2}\,O_2 \rightarrow CO_2$. The oxygen thus supplied makes it possible to carry out decarburisation treatments and to lower the temperature of the steel before treatment, since the supply of oxygen induces an exothermic effect.

The advantage of such a method lies in the fact that a proportion of the oxygen blown into the treatment chamber comes into contact with the vertical walls of the upper part 4 and of the intermediate ring 5 of the chamber, thus preventing the splashes of metal originating from the treatment from adhering to the said walls.

The frequency of treatments required for slag-out is reduced, which thus gives rise to a longer lifespan for the base of the lower part 6 of the chamber.

In fact, during slag-out, an iron oxide is formed which falls into the bottom of the lower part of the chamber, which is lined with refractory material of the chromium-magnesium oxide type.

The refractory material then combines with the iron oxide originating from slag-out, which leads to a lowering of the melting point of the refractory material and hence an acceleration of its wearing-away by erosion.

The present invention also relates to a vacuum treatment chamber for implementing the above-described method.

The chamber 3 is equipped in its intermediate ring 5 with at least two horizontal tuyeres 11, 12 permitting blowing of oxygen.

The horizontal tuyeres 11, 12 are uniformly distributed at the periphery of the cheer 3 and are provided substantially in the centre of the intermediate ring 5, above the bath of metal to be treated 2.

In the illustrative embodiment shown, the intermediate ring 5 is equipped with two tuyeres 11, 12 which are facing each other, diametrically opposed, arranged at mid-height on the said intermediate ring 5 of the chamber 3.

I claim:

1. A method for decarburisation of steel in a vacuum treatment chamber consisting of an upper part (4) in the shape of a bell, of an intermediate ring (5) and of a lower part (6) in which a bath of metal to be treated (2) is located and which is equipped with two legs (7, 8) immersed in a steel ladle (9) containing all the metal (10) to be treated, comprising blowing oxygen horizontally over the bath of metal to be treated (2), at the level of the intermediate ring (5) of said chamber.

2. A vacuum treatment chamber for implementing the method according to claim 1, wherein at least two horizontal tuyeres (11, 12) are provided in the intermediate ring (5) of the said chamber (3) above the bath of metal to be treated (2).

3. A vacuum treatment chamber according to claim 2, wherein the horizontal tuyeres (11, 12) are uniformly distributed at the periphery of the chamber (3).

4. A vacuum treatment chamber according to claim 2, characterised in that the tuyeres (11, 12) are provided substantially in the centre of the intermediate ring (5) of the said chamber (3).

5. A method for decarburisation of steel in a vacuum treatment chamber consisting of an upper part (4) in the shape of a bell, of an intermediate ring (5) and of a lower part (6) in which a bath of metal to be treated (2) is located and which is equipped with two legs (7,8) immersed in a steel ladle (9) containing all the metal (10) to be treated, consisting of blowing oxygen horizontally over the bath of metal to be treated (2), at the level of the intermediate ring (5) of said chamber.

* * * * *